United States Patent [19]

Knürr

[11] Patent Number: 5,068,944

[45] Date of Patent: Dec. 3, 1991

[54] CONTAINER WITH A CARRYING HANDLE

[75] Inventor: Hans Knürr, Kirchheim, Fed. Rep. of Germany

[73] Assignee: Knurr-Mechanik fur die Elektronik Aktiengesellschaft, Munich, Fed. Rep. of Germany

[21] Appl. No.: 550,760

[22] Filed: Jul. 11, 1990

[30] Foreign Application Priority Data

Jul. 24, 1989 [DE] Fed. Rep. of Germany ..... 3924450

[51] Int. Cl.[5] ..... B65D 25/00; E05B 5/00

[52] U.S. Cl. ..... 16/112; 16/115; 16/126; 190/115

[58] Field of Search ..... 16/112, 115, 126; 190/115

[56] References Cited

U.S. PATENT DOCUMENTS

| | | | |
|---|---|---|---|
| 193,162 | 7/1877 | Kaufmann | 16/126 |
| 926,986 | 7/1909 | Hulbert | 16/126 |
| 1,227,034 | 5/1917 | Boyum . | |
| 1,374,126 | 4/1921 | Walter | 16/112 |
| 2,163,830 | 6/1939 | Clifford | 16/112 |
| 2,221,829 | 11/1940 | Worthington | 16/115 |
| 2,309,029 | 1/1943 | Wheary, Jr. | 190/115 |
| 2,323,094 | 6/1943 | Levin | 16/115 |
| 3,418,681 | 12/1968 | Szabo | 16/115 |
| 3,447,195 | 6/1969 | Bush | 16/115 |
| 3,844,003 | 10/1974 | Angermann | 16/112 |
| 4,157,763 | 6/1979 | Betlejewski et al. . | |

FOREIGN PATENT DOCUMENTS 0312020 4/1989 European Pat. Off. .

*Primary Examiner*—Robert L. Spruill
*Assistant Examiner*—Carmime Cuda
*Attorney, Agent, or Firm*—Fleit, Jacobson, Cohn, Price, Holman & Stern

[57] ABSTRACT

The carrying handle comprises a handle strip and two terminal legs, which are articulated to the narrow side of the container. The legs are subdivided into two portions, which are interconnected by means of an intermediate joint. The articulation axis of the intermediate joint and of the container side joint are parallel to the handle strip. The leg portions are bent in the inoperative position of the carrying handle, so that they come to rest parallel to one another. Thus, the legs are shortened in the inoperative position, so that they do not project over the outer edges, particularly in the case of narrow containers and are instead located within the predetermined dimensions.

11 Claims, 1 Drawing Sheet

CONTAINER WITH A CARRYING HANDLE

BACKGROUND OF THE INVENTION

The invention relates to a dimensionally rigid container, e.g. a shell-like case, with at least one carrying handle articulated to an outside, which comprises a handle strip and two terminal legs and which on the container side is articulated parallel to the handle strip.

Such dimensionally rigid containers are widely used. They are used as suitcases, for carrying high-value tools and for electronic appliances. The carrying handle or handles are fitted roughly centrally to a narrow side and articulated in such a way that they drop down or collapse on the particular narrow side as a result of their own weight as soon as the container is put down. In the case of narrow cases the carrying handle projects over the edge of the case. It then forms a projection, which is considered to a hindrance in many cases, because the particular user can hit against it or because the bulkiness of the container is increased. This is the case not only during transportation, but also in the open state, particularly if the container contains professional equipment, which is to be used in situ under constricted space conditions with the container open.

Numerous investigations have been carried out to position the carrying handle in such a way that it is a minimum hindrance when not in use. French patent 1 460 833 discloses a number of variants for flush case handles. The legs are inter alia articulated at right angles to the longitudinal direction of the carrying handle both on the container side and on the handle side. By displacing the articulation points in the direction of the handle strip either in longitudinal slots within the said strip or in recesses in the container wall, it is possible to stretch, flatten and lower in flush manner into a container wall recess the said carrying handle. In addition, the large number of components necessary causes rattling in the case of transport vibrations, which can be considered unpleasant. The sliding guides also suffer from the disadvantage of low lateral stability.

German patent 8 45 838 discloses a flush, rigid carrying handle for fitting in a container wall cutout.

A handle for a lady's handbag is known from German patent 5 09 972. The handle is swung completely into the interior of the bag when it is not in use. Thus, it is always necessary to open the handbag and carry out a manipulation in its interior.

SUMMARY OF THE INVENTION

It is the object of the invention to provide a container of the aforementioned type, in which the carrying handle can be housed in space-saving and without projecting outwards in a hindering manner in the case of a flat container shape is said container is put down or aside and in which it is still possible to ensure easy handling of said handle.

This object is achieved in that the legs in each case comprise two portions, which are interconnected via an intermediate joint axially parallel to the container side joint and that the length of the container side portion is at a maximum the spacing between the container side joint and the container edge and the length of the other portion is at the most the same as the container narrow side.

The invention has the advantage that the legs of the carrying handle are virtually folded up in the inoperative position and can consequently undergo a reduction in length. As the lengths of the leg portions are in each case adapted to the width of the container narrow side it is ensured that the handle is stowed within the dimensions of the narrow side. On pulling it assumes its stretched or extended position, without requiring manipulations on the handle or on the container.

It is fundamentally appropriate for an easy action construction of both the container side joint and the intermediate joint, so that the leg portions automatically assume their folded up position as a result of their own weight in the inoperative state. However, it can be appropriate to apply a predetermined friction to the joints and this is dimensioned in such a way that they maintain their stretched or folded position until the handle is used by the user. This has the advantage that, in the case of a brief putting down of the container, such as is e.g. frequently the case when travelling with a suitcase, the carrying handle remains ready to grip until the container is put down. This measure ensures that rattling noises do not occur during movement.

It is particularly advantageous for the two leg portions to be axially displaced and to be parallel and juxtaposed in the angular state. This leads to a particularly flat arrangement.

Even in the case of an ergonomically adapted, thick handle strip, the handle does not protrude if said handle and the associated leg portion come to rest in a depression in the container narrow side in the angular state.

According to a preferred development of the invention the container side leg portions comprise two axially displaced arms between which is articulated the handle side portion. This has the advantage that the two leg portions can be interconnected in a particularly stable manner because as a result of the two-sided support of the handle side portion tilting and turning of the intermediate joint is prevented, particularly if the interengaging parts of the arms and the handle side portion are constructed as guide surfaces.

The intermediate joint can be simply constructed in that a pin mounted in the arms is guided through the handle side portion, or the handle side portions are provided with two lugs, which engage with bearing eyelets in the two arms.

It is particularly advantageous with respect to stability and manufacture for the handle strip and associated leg portions to be constructed in one piece.

A flat, but nevertheless stable container-side mounting of the two arms is brought about in that they are articulated on their outsides to a protuberance on the container narrow side. Thus, the handle side leg portions can be completely inserted between the two arms.

BRIEF DESCRIPTION OF THE DRAWINGS

The invention is described in greater detail hereinafter relative to an embodiment and the attached drawings, wherein show.

DETAILED DESCRIPTION OF THE PREFERRED EMBODIMENT

Figure 1:
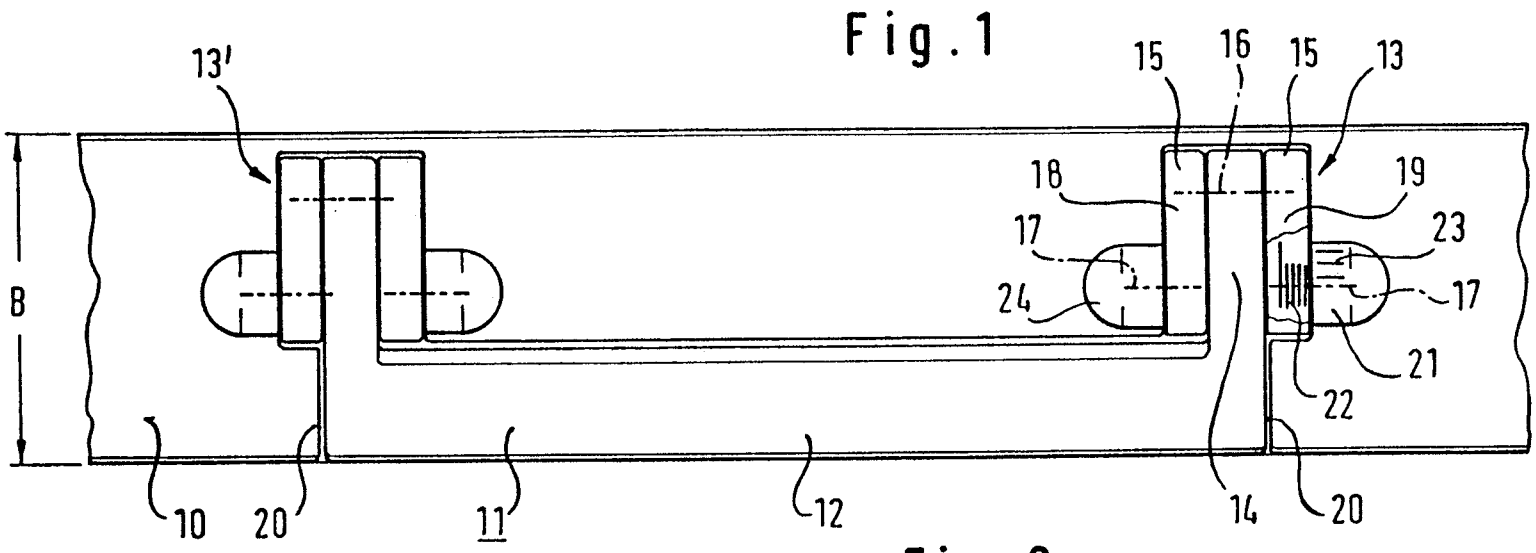
FIG. 1 Diagrammatically a partial plan view of a container narrow side with a carrying handle in the put down position.

FIG. 1 shows the narrow side 10 of a container, which can be a suitcase, the casing of an electrical appliance or the like, in the vicinity of a carrying handle 11. The width of the narrow side 10 is designated B.

The carrying handle comprises a handle strip 12 and two terminal leg assemblies 13, 13', which in each case comprise a handle side portion or leg 14 and a container side portion or link 15. The handle side portions 14 and the handle strip 12 are in one piece, e.g. made from plastic. As the assemblies 13, 13' in each case have an identical construction, reference is only made hereinafter to the assembly 13 shown to the right.

The handle side portions 14 and container side portions 15 are interconnected by means of an intermediate joint 16, which makes it possible to bend the two portions 14, 15. FIG. 1 shows the position in which the handle side and container side portions 14, 15 are "folded" and come to rest in juxtaposed form substantially parallel to the narrow side 10. The length of the handle side and container side portions 14, 15 is such that no part of the carrying handle 11 projects over the narrow side 10. In the represented embodiment the length of the handle side portion 14 corresponds to the width B of the narrow side 10. The container side portion 15, which is articulated roughly centrally in the narrow side 10 by means of a joint 17 is correspondingly only half as long as the handle side portion 14 and extends to the edge of the narrow side 10.

The container side portion or link 15 comprises two parallel arms 18, 19, which are spaced from one another in the axial direction of the joint 17 and the intermediate joint 16. Between the two arms 18, 19, which are side-reversed, but otherwise identical, is located the handle side portion 14. At least half of the gripping strip 12 in the represented, angular position of the handle 11 is located in a depression 20 in the narrow side 10.

On their outsides, i.e. on the sides remote from the handle side portion 14, the two arms 18, 19 are in each case articulated to a hump-like protuberance 21 or 24, which consequently belong the container side joint 17.

As is illustrated by a partial section of a container side joint 17, a helical spring 22 is arranged around the associated axis and which is pretensioned in such a way that the arms 18 and 19 are brought into the swung in position and maintained there. Thus, the handle 11 automatically assumes a space-saving position when it is not in use. It is fundamentally sufficient if there is only a helical spring 22 on one of the arms 18 or 19. However, it can also be appropriate to provide such a spring in both arms 18, 19. It is even more appropriate at this point to use leaf springs and a leaf spring is associated with each arm 18, 19, which gives a very space-saving construction.

In addition, with the aid of the helical spring 22 and a scale 23, which can e.g. be applied to the associated protuberance 21, a weight measurement can be carried out, so that in this way the container weight can be read off the said scale. If the carrying handle 11 were gripped, then the arms 18, 19 would swing out to a greater or lesser extent as a function of the container weight and the stretching of the arms 18, 19 would take place counter to the spring tension of the helical spring 22. The arm 19 or a not shown marking applied thereto serves as an indicator for said measurement.

Figure 2:
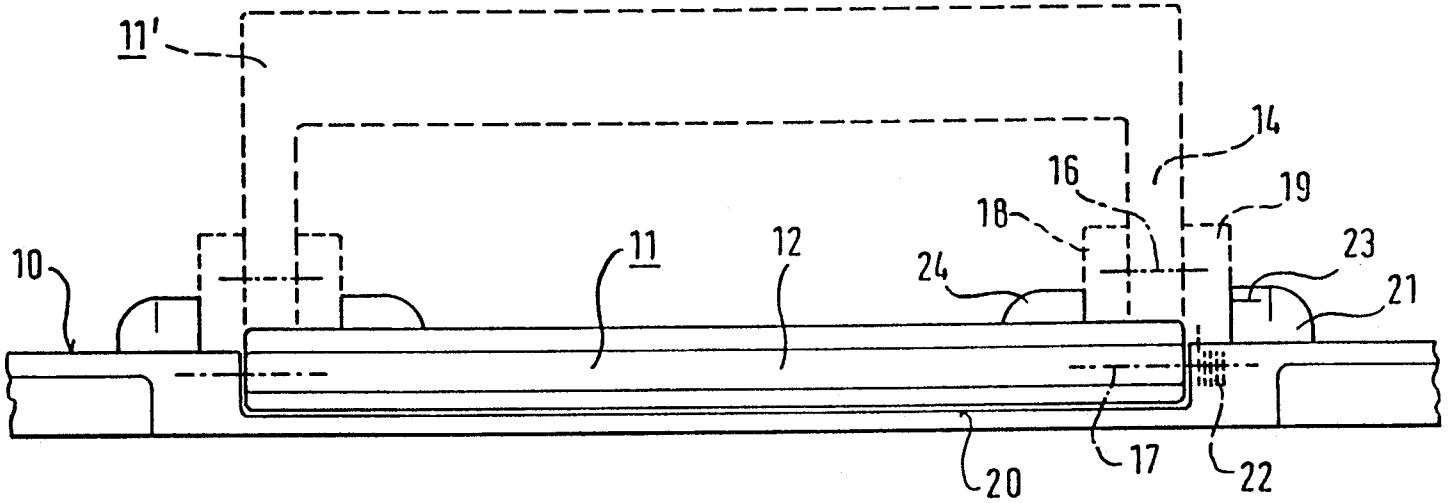
FIG. 2 The constellation according to FIG. 1 in a side view, as well as the carrying handle in the swung out state (broken line form).

FIG. 2 illustrates in continuous line form the angular inoperative position of the carrying handle 11 shown in FIG. 1. In addition, it shows in a broken line form the extended position of the carrying handle 11', in which the handle and container side portions 14, 15 are oriented stretched at right angles to the narrow side 10. The intermediate joints 16 are moved upwards and aligned with the container side joint 17. The length of the arms 13, 13' consequently corresponds to the length of the handle and container side portions 14, 15.

What we claim is:

1. A dimensionally rigid container having an outer wall with a length dimension including a longitudinal centerline and a width dimension, and a handle structure mounted on said wall for carrying the container, the handle structure comprising an elongated handle grip with terminal legs, and links pivotally connected to the respective legs about a first pivot axis, the links being pivotally connected to said wall about a second pivot axis parallel to the first pivot axis, said pivot axes being parallel to the longitudinal centerline of said wall and parallel to the handle grip, the handle structure being configured for folding into an inoperative position substantially flat against a surface of said wall with the links extending from said second pivot axis towards but not beyond one longitudinal edge of said wall and with the legs extending adjacent the links from said first pivot axis through said second pivot axis towards but not beyond an opposite longitudinal edge of said wall, the handle structure being unfoldable away from said wall to an extended container-carrying position.

2. A container as claimed in claim 1 wherein each link comprises a pair of arms straddling the respective leg.

3. A container as claimed in claim 1 wherein the respective legs are pivotally connected to the respective links by respective first joint assemblies, the respective links are pivotally connected to the container wall by respective second joints assemblies and wherein at least one of the joint assemblies includes friction means for resisting pivotal movement between elements defining the joint assembly.

4. A container as claimed in claim 1 wherein the respective legs are pivotally connected to the respective links by respective first joint assemblies, the respective links are pivotally connected to the container wall by respective second joint assemblies and wherein at least one of said joint assemblies includes spring means for urging the handle structure towards the inoperative position.

5. A container as defined in claim 4 wherein the spring means forms part of a spring balance structure incorporated in said joint assembly, the spring balance structure further including a scale on one element defining the joint assembly and an indicator cooperating with said scale, the indicator being formed by another element defining the joint assembly.

6. A container as defined in claim 1 wherein the container wall has a depression for receiving the handle structure in the inoperative position.

7. A container as defined in claim 1 wherein the legs are integral with the handle grip.

8. A container as defined in claim 1 wherein the links are pivotally connected to projecting portions on said wall.

9. A container as defined in claim 1 wherein the container is a suitcase.

10. A dimensionally rigid container having an outer wall with a length dimension including a longitudinal centerline and a width dimension, and a handle structure mounted on said wall for carrying the container, the handle structure comprising an elongated handle grip with terminal legs and links pivotally connected to the respective legs about a first pivot axis, the links being pivotally connected to said wall about a second pivot axis parallel to the first pivot axis, said pivot axes being parallel to the longitudinal centerline of said wall and parallel to said elongated handle grip, the handle structure being configured for folding into an inoperative position substantially flat against a surface of said wall with the links extending from said second pivot axis towards but not beyond one longitudinal edge of said wall and with the legs extending adjacent the links from said first pivot axis towards but not beyond an opposite longitudinal edge of said wall, the handle structure being unfoldable away from said wall to an extended container-carrying position, wherein the respective legs are pivotally connected to the respective links by respective first joint assemblies, the respective links are pivotally connected to the container wall by respective second joint assemblies, wherein at least one of said joint assemblies includes spring means for urging the handle structure towards the inoperative position, the spring means forming part of a spring balance structure incorporated in said joint assembly, the spring balance structure further including a scale on one element defining the joint assembly and an indicator cooperating with said scale, the indicator being formed by another element defining the joint assembly.

11. A container as defined in claim 1 wherein each link comprises a pair of arms straddling the respective leg.

* * * * *